US006604303B2

(12) United States Patent
Covatch

(10) Patent No.: US 6,604,303 B2
(45) Date of Patent: Aug. 12, 2003

(54) STEEL TOE SHOE CONSTRUCTION

(75) Inventor: Charles E. Covatch, Martinsburg, PA (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 09/944,789

(22) Filed: Aug. 31, 2001

(65) Prior Publication Data

US 2003/0041479 A1 Mar. 6, 2003

(51) Int. Cl.[7] ..... A43C 13/14; A43B 23/08; A43B 23/10

(52) U.S. Cl. ..... 36/77 R; 36/107; 36/72 R; 36/76 C; 12/146 D

(58) Field of Search ..... 36/77 R, 77 M, 36/96, 107, 55, 76 C, 72 R; 12/146 D

(56) References Cited

U.S. PATENT DOCUMENTS

| | | | | | |
|---|---|---|---|---|---|
| 898,710 | A | * | 9/1908 | White | 36/55 |
| 1,034,744 | A | * | 8/1912 | Tilt et al. | 36/77 R |
| 1,370,797 | A | * | 3/1921 | Egerton | 36/77 R |
| 2,354,338 | A | * | 7/1944 | Stritter | 36/77 R |
| 3,444,572 | A | * | 5/1969 | Broughton | 36/77 R |
| 3,798,804 | A | * | 3/1974 | Funck | 36/72 R |
| 4,574,497 | A | * | 3/1986 | Jindra | 36/72 R |
| 5,974,697 | A | * | 11/1999 | Tseng | 36/77 R |
| 6,029,373 | A | * | 2/2000 | Diradour et al. | 36/77 R |

FOREIGN PATENT DOCUMENTS

| | | | | | |
|---|---|---|---|---|---|
| GB | 2060350 | A | * | 5/1981 | A43B/7/32 |
| WO | WO 92/14372 | A1 | * | 9/1992 | A43B/7/32 |

* cited by examiner

*Primary Examiner*—Anthony D. Stashick
(74) *Attorney, Agent, or Firm*—St. Onge Steward Johnston & Reens LLC

(57) ABSTRACT

Footwear and its method of construction are provided. An insole forepart is attached to the bottom of the sock liner. An upper having a vamp lining with a toe part is provided where toe part is stitched to the sock liner such that the vamp lining and the sock liner together define a volume for receiving a wearer's foot. A steel toe is positioned substantially around the toe part of the vamp lining. An outsole having a forward portion formed of a material having a first resiliency characteristic is provided. A stiffener is positioned between the forward portion of the outsole and the insole forepart where the stiffener is formed of a material having a second resiliency characteristic less than the first resiliency characteristic.

8 Claims, 4 Drawing Sheets

STEEL TOE SHOE CONSTRUCTION

TECHNICAL FIELD

This invention relates to footwear including boots and shoes.

BACKGROUND

Safety shoes are known for their rigid and rugged construction, where comfort is often sacrificed for the benefit of safety. Steel toes for providing rigid protection to a wearer's toes are often required in many safety shoes. The steel toe is incorporated into a shoe by inserting a flange portion of the steel toe under an insole member of the shoe. Some steel toe shoes are made using Opanka construction. Opanka is a type of shoe construction where the shoe upper is hand-sewn, together with a sock liner, to an outsole. Sandals are commonly made using the Opanka construction. To provide flexibility some Opanka construction do not include an insole. However, an example of a footwear construction that employs aspects of Opanka construction with a steel toe and an insole can be found in U.S. Pat. No. 6,067,732, Shoe Construction with Steel Toe, incorporated herein by reference.

SUMMARY

The invention relates to a footwear construction and method for providing flexibility and support in a steel toe shoe, thereby providing an improved fit and increased comfort to the wearer.

In a general aspect of the invention, the method includes attaching an insole forepart to the bottom of the sock liner. An upper having a vamp lining with a toe part is provided where the toe part is stitched to the sock liner such that the vamp lining and the sock liner together define a volume for receiving a wearer's foot. A steel toe is positioned substantially around the toe part of the vamp lining. An outsole having a forward portion formed of a material having a first resiliency characteristic is provided. A stiffener is positioned between the forward portion of the outsole and the insole forepart where the stiffener is formed of a material having a second resiliency characteristic less than the first resiliency characteristic.

In another aspect of the invention, a footwear construction includes a sock liner with an insole forepart attached to the bottom of the sock liner and an upper having a vamp lining with a toe part. The toe part is stitched to the sock liner such that the vamp lining and the sock liner together define a volume for receiving a wearer's foot. The footwear construction also includes a steel toe positioned substantially around the toe part of the vamp lining, an outsole having a forward portion formed of a material having a first resiliency characteristic, and a stiffener between the forward portion of the outsole and the insole forepart, the stiffener formed of a material having a second resiliency characteristic less than the first resiliency characteristic.

Among other advantages, the stiffener is positioned to provide rigid support to a portion of the wearer's foot positioned underneath the steel toe so that the shoe toe does not readily bend in a downward direction with respect to the rest of the shoe and to provide flexible support to allow the shoe to bend in an upward direction with respect to the rest of the shoe.

The toe portion of the steel toe is allowed to flex in an upward direction, but does not bend in a downward direction. The resiliency of the stiffener adds additional mechanical support to the steel toe.

In embodiments of this invention, the stiffener is formed as a set of stiffener bars. The stiffener is positioned in the front portion of the outsole. The outsole has a walking surface and an opposed surface opposite to the walking surface, and the stiffener is embedded in the opposed surface of the outsole. The stiffener is sized and shaped to provide rigid support to a portion of the wearer's foot positioned underneath the steel toe. The stiffener has a ribbed top surface. The stiffener has a set of indentations along the top surface.

In another aspect of the invention, a footwear construction includes a sock liner with an insole forepart attached to the bottom of the sock liner and an upper having a vamp lining with a toe part. The toe part is stitched to the sock liner such that the vamp lining and the sock liner together define a volume for receiving a wearer's foot. The footwear construction also includes a steel toe positioned substantially around the toe part of the vamp lining, an outsole having a forward portion formed of a material having a first resiliency characteristic, and a stiffener between the forward portion of the outsole and the insole forepart, the stiffener formed of a material having a second resiliency characteristic less than the first resiliency characteristic.

The details of one or more embodiments of the invention are set forth in the accompanying drawings and the description below. Other features, objects, and advantages of the invention will be apparent from the description and drawings, and from the claims.

DETAILED DESCRIPTION

Figures 1A, 1B:
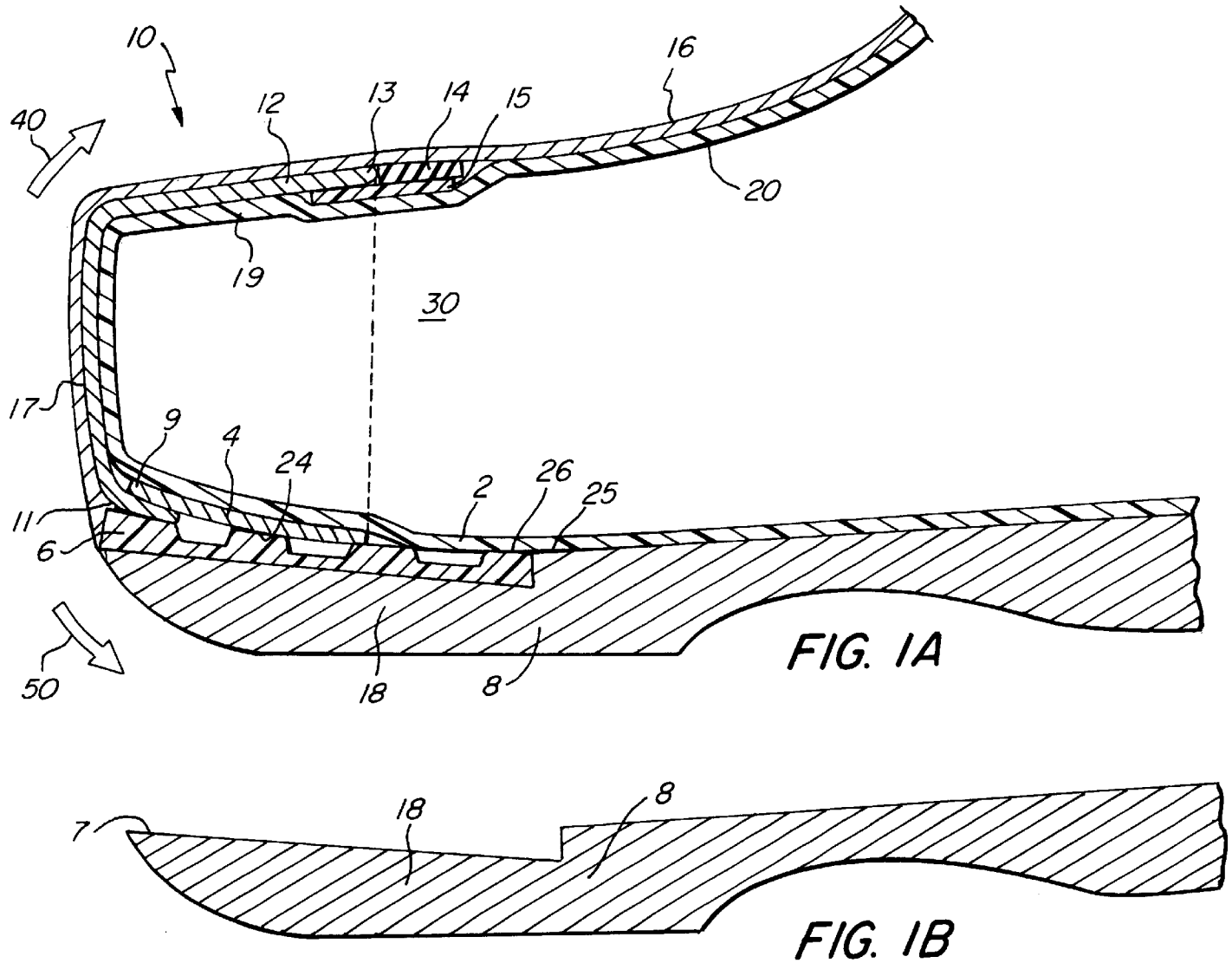
FIG. 1A is a cross-sectional view of a steel toe shoe.
FIG. 1B is a cross-sectional view of an outsole without a stiffener.

Referring to FIG. 1A, a shoe 10 of the type used in industrial or rugged outdoor environments is shown to include an upper 16 within which a steel toe 12 is positioned to protect the wearer's toes from falling heavy or penetrating sharp objects that could injure the wearer's foot. As explained in greater detail below, shoe 10 includes a stiffener 6 positioned beneath steel toe 12 to provide rigid structural support to steel toe 12 and to a toe portion of the shoe while still providing flexibility to the shoe. Thus, shoe 10 has a rugged construction that provides additional structural support and comfort while, as further explained below, prevents an edge 13 of steel toe 12 from placing pressure along the top of the wearer's foot while providing a cushioning environment for the foot to rest.

Shoe 10 includes a vamp lining 20 having a shape relatively the same as upper 16 and stitched within the upper. Upper 16 is made, for example, of leather while vamp lining 20 is made from relatively soft materials, such as plush fabric to provide comfort to the wearer during walking. The bottom peripheral edge of vamp lining 20 is sewn along the periphery of a sock liner 2 using a strobel stitching or a closing stitching such that upper 16 with vamp lining 20 and sock liner 2 together define the volume of shoe 10 within which the wearer's foot is placed. Steel toe 12 is placed around a toe part 19 of vamp lining 20. Shoe 10 also includes an insole forepart 4 that is adhesively attached to the bottom of sock liner 2. Insole forepart 4 is formed from a relatively stiff insole board, such as fiberboard material and lends mechanical support to steel toe 12 at the forepart of shoe 10. In the embodiment shown, the fiberboard has a 4 iron thickness (approximately 5/64" thickness).

Insole forepart 4 has a length that is less than the length of sock liner 2 and generally commensurate with the length of steel toe 12. In particular, the length of insole forepart 4 extends below the phalanges of the foot but generally does not extend to the metatarsals of the wearer's foot, i.e. the part of the foot between the phalanges and the tarsus. Thus, although the insole forepart is relatively stiff, flexibility of the overall shoe is maintained. Insole forepart 4 is adhesively attached to outsole 8. An outsole 8 is attached to upper 16 with Opanka stitching.

Figure 2A:
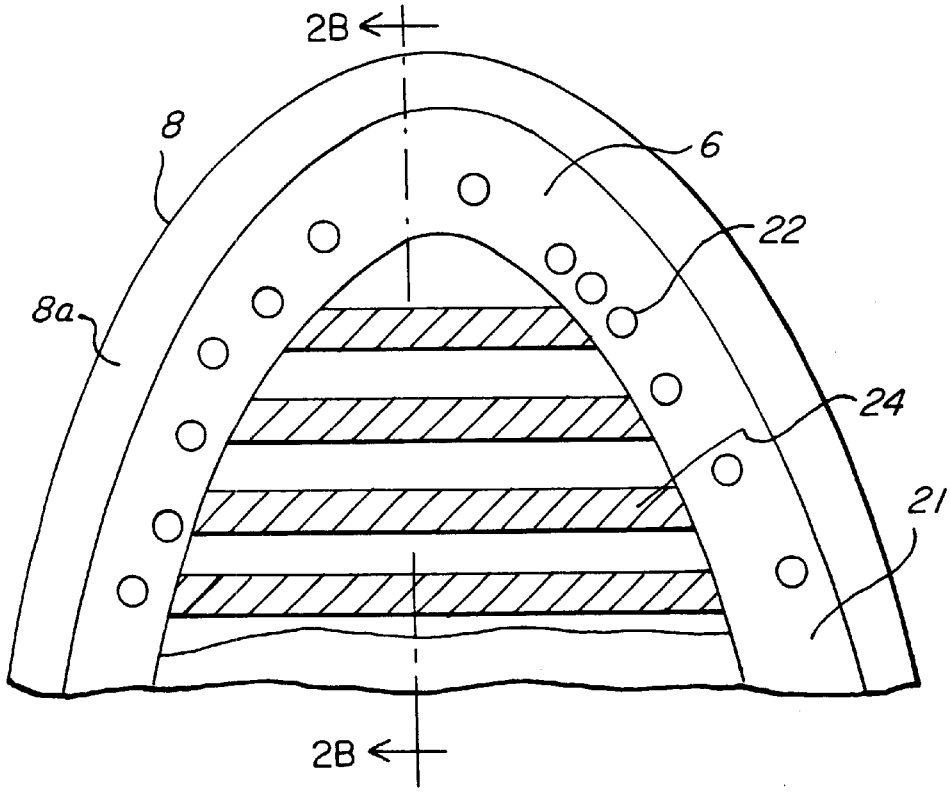
FIG. 2A is a top view of a stiffener.
Figure 2B:
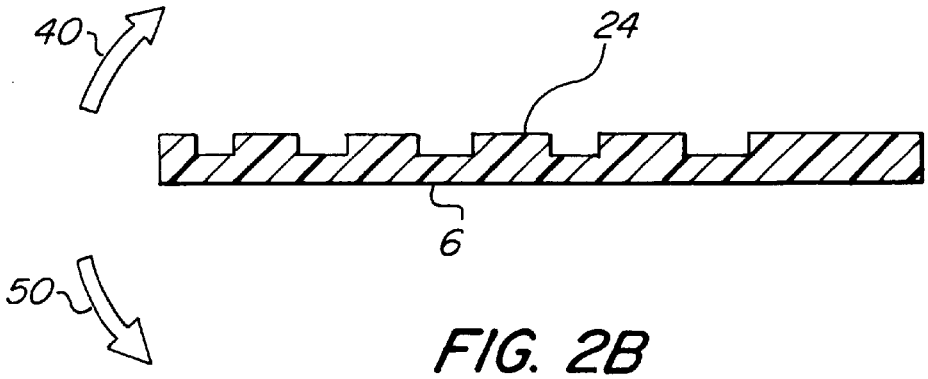
FIG. 2B is a cross-sectional view of a stiffener taken along lines 2B—2B of FIG. 2A.

In particular, referring to FIGS. 1A–1B and 2A–2B, a front portion 18 of outsole is formed to include a cavity 7 within which stiffener 6 is adhesively secured. As shown in FIG. 2A, cavity 7 has a D-shape and occupies substantially the entire toe front portion of outsole 8 with a narrow peripheral wall 8A surrounding the front portion of the cavity. Stiffener 6 is sized and shaped to fit snugly within cavity 7 and has a thickness such that a top surface 26 of the stiffener is flush with a top surface 25 of outsole 8. Stiffener 6 is formed of a material (e.g., plastic), more rigid than the material of outsole 8 (e.g., rubber).

Outsole 8 with stiffener 6 is adhesively attached to insole forepart 4 except for a loose edge 9 at a toe of insole forepart 4. A flange 11 of steel toe 12 fits underneath loose edge 9 of insole 4 and rests upon stiffener 6 so that steel toe 12 is wedged between them. Thus, insole 4 and stiffener 6 provide mechanical support to steel toe. Stiffener 6 provides greater structural support than previous designs due to the increased rigidity of stiffener 6 with respect to outsole 8. Stiffener 6 also adds rigidity to the front portion of the shoe by preventing toe part from flexing up in a first direction 50 which would allow a top distal edge 13 of steel toe 12 to bend down toward the wearer's foot.

Padded material 15 is placed on top of vamp lining 20 followed by a rubber strip 14 both of which cover edge 13 of steel toe 12 to protect the wearer's foot from edge 13. In other words, adding padding material 15 and rubber strip 14 minimize any ridges on the outside and inside of the shoe by creating a smooth transition from steel toe 12 and vamp lining 20. Together rubber strip 14, padded material 15, steel toe 12 and stiffener 6 provide a comfortable cavity for the wearer's foot which protects the foot from the pressure of shoe toe edge 13 while maximizing the benefit of the protection from steel toe 12.

In this embodiment, stiffener 6 has ribs 24 formed on the upper surface of stiffener 6 while the bottom surface of the stiffener is flat. In use, ribs 24 are oriented to allow shoe system 10 ease to flex in a second direction 40 where the wearer's toe can flex upward. At the same time, stiffener 6 also provides resistance to flexing in first direction 50 where the toe moves in a downward direction.

In this embodiment, ribs 24 are approximately 5/32" wide at the apex and 3/16" wide at the base. The spacing between each rib 24 is approximately 3/16". By having a base of each rib longer than the apex length, the shape of each rib 24 facilitates a movement in the direction where the wearer's toe can flex upward. The spacing between each rib further enhances flexing in this direction. Stiffener 6 is approximately 2¾ inches long and 4 inches wide. The length of stiffener 6 generally depends on the length of steel toe 12. That is, the length of stiffener 6 is desired to extend from a front portion 17 of steel toe 12 beyond a vertical line 30 drawn from the edge 13 to ensure maximum rigidity in direction 50 and flexibility in direction 40. Stiffener 6 is approximately 2/16" thick from the top of rib 24 and approximately 1/16" thick from the bottom of rib 24. The periphery of stiffener 6 has an approximately ½" band 21 that extends around stiffener 6. Band 21 is approximately 2/16" thick. Band 21 has holes 22 approximately ¼" in diameter and randomly dispersed along the band less than 2/16" deep to facilitate the flexing in the direction where the wearer's toe can flex upward in a similar fashion as the spacing between ribs 24.

Figure 3:
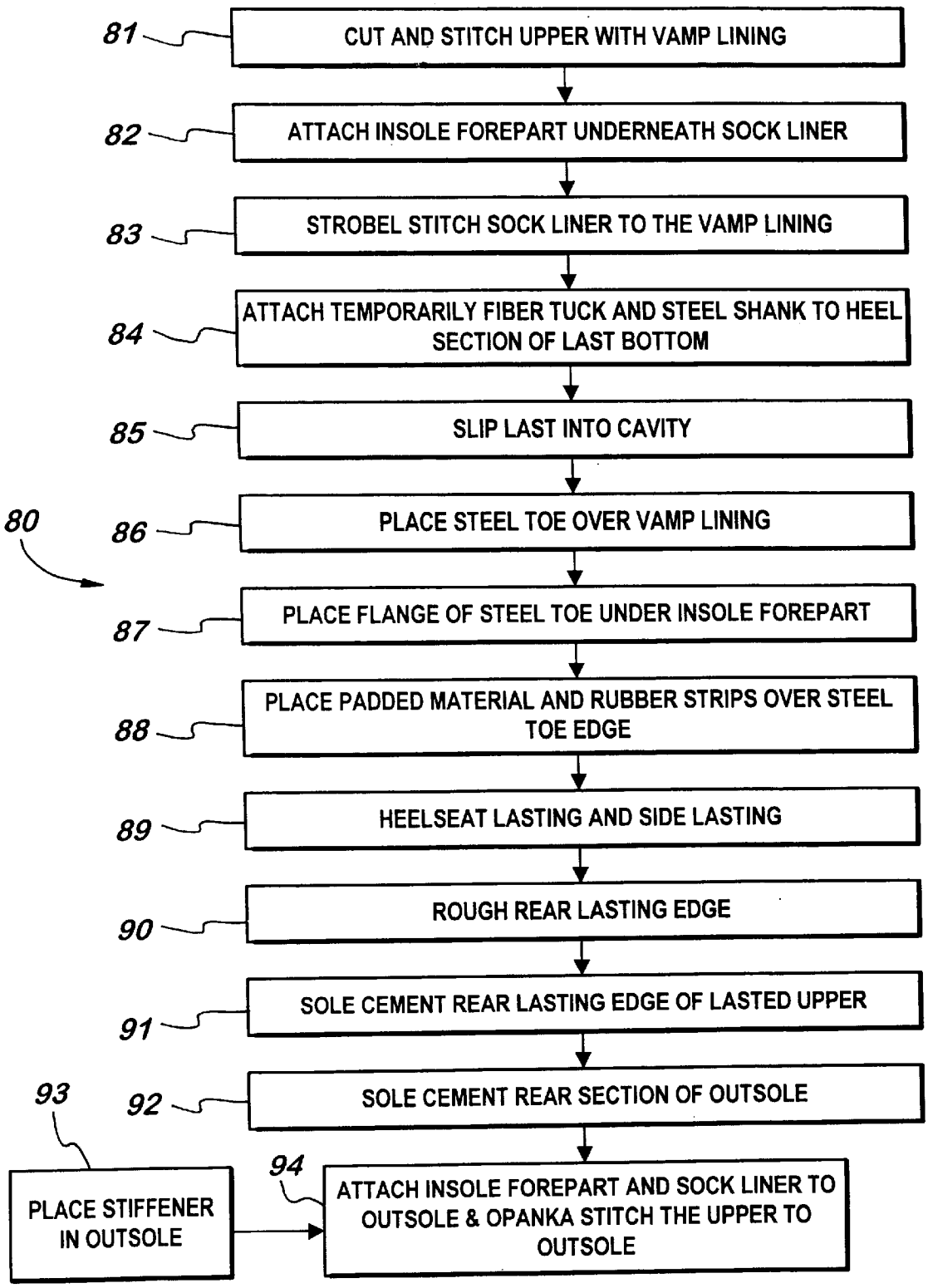
FIG. 3 is a flow diagram of an Opanka construction of a steel toe shoe with a stiffener.

Referring first to FIG. 3, a process 80 for constructing shoe 10 includes cutting upper 16 and stitching upper 16 to vamp lining 20 (step 81). If required, a counter is inserted to provide structural support to the heel portion of the shoe. Insole forepart 4 is adhesively attached underneath sock liner 2 (step 82). Toe portion 19 of vamp lining 20 is strobel stitched to sock liner 2 and insole forepart 4 (step 83). By joining toe portion 19 of vamp lining 20 to sock liner 2, a volume is formed for receiving a toe portion of the wearer's foot. A fiber tuck and a steel shank (both not shown) are temporarily stapled or tacked to a heel section of a last bottom (step 84). A last is inserted into the volume to expand vamp lining 20 to its desired shape (step 85). An adhesive is applied to steel toe 12 and/or vamp lining 20. Steel toe 19 is then slid over vamp lining 20 to substantially surround toe portion 19 of vamp lining 20 (step 86). Simultaneously, flange 11 of steel toe 12 is inserted under insole forepart 4 (step 87). Thus, steel toe 12 is secured around vamp lining 20 and to insole forepart 4. Padded material 15 is placed on top of vamp lining 20 followed by a rubber strip 14 so that each cover edge 13 of steel toe 12 (step 88). This creates a smooth transition from steel toe 12 to vamp lining 20 and prevents an "x-ray effect" produced by a ridge showing through upper 16. A rear lasting edge (not shown) of upper 16 is lasted by a) heelseat lasting and b) side lasting whereby the rear lasting edge is now folded over the rear part of the tuck (step 89). Sole cement is applied to the rear lasting edge of lasted upper 16 (step 90). Sole cement is applied rear lasting edge of lasted upper (step 91). Sole cemented is also applied to a rear section (not shown) of outsole 18 (step 92). Outsole 18 is molded to form a cavity 7. Stiffener 6 is adhesively placed within cavity 7 (step 93). Insole forepart 4 and a portion of sock lining 2 not covered by insole forepart 4 are adhesively attached to outsole 18 except loose edge 9 of insole forepart 4 so that flange 11 is wedged between stiffener 6 and insole forepart 4 (step 94). Finally, upper 16 is attached to an outsole 18 by Opanka stitching upper 16 by hand to outsole 18 (step 94).

Figure 4A:
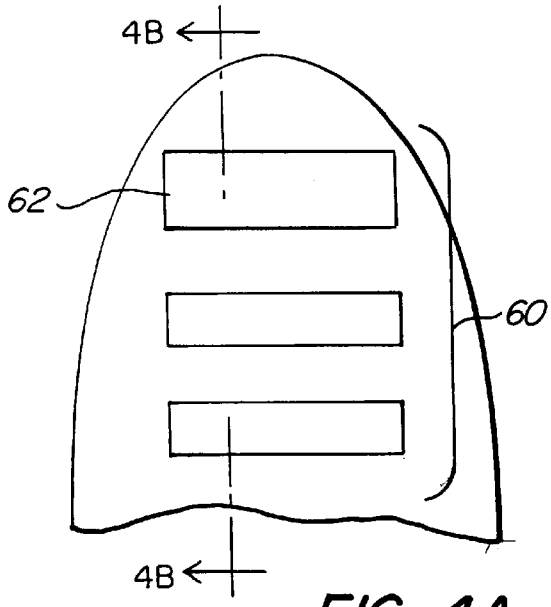
FIG. 4A is a cross-sectional view of a steel toe with a set of stiffener bars.
Figure 4C:
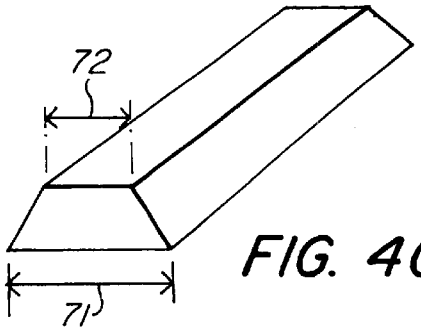
FIG. 4C is a single stiffener bar.
Figure 4B:
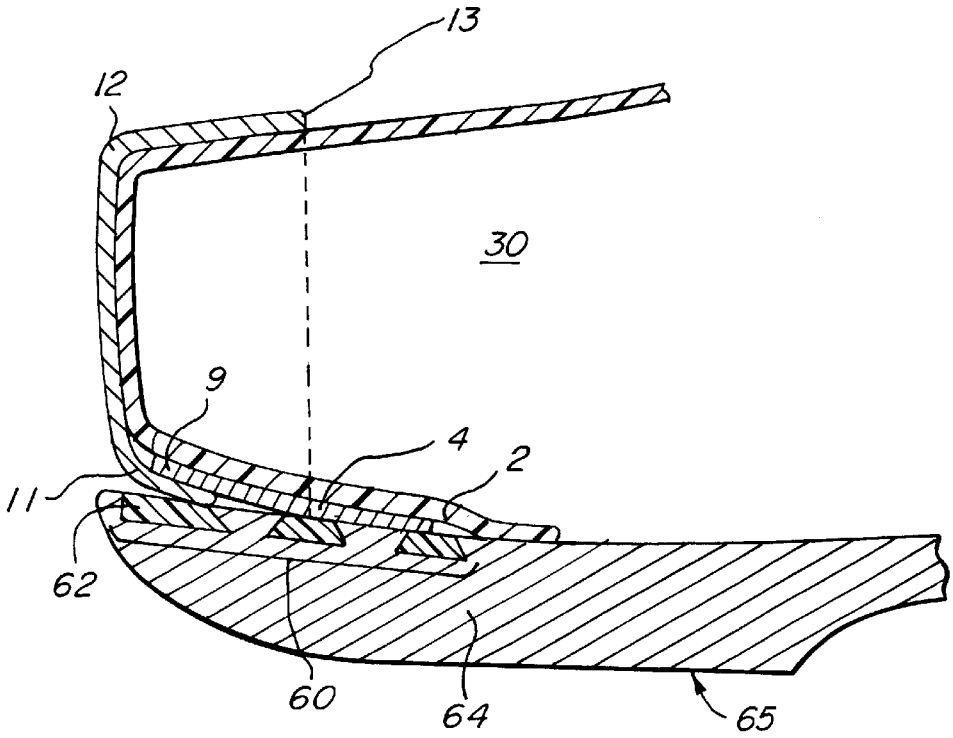
FIG. 4B is a cross-sectional view of a steel toe shoe taken along line 4B—4B of FIG. 4A.

Referring to FIGS. 4A–4C, an alternative stiffening system for providing rigidity at the forepart of shoe 10 is in the form of a set of stiffener bars 60 embedded within a front portion 64 of an outsole 65. One stiffener 62 is positioned beneath and supports steel toe 12. The remaining stiffeners provide rigid support for insole 8 positioned underneath the portion of the wearer's foot underneath the steel toe. Similar to the functional shape of ribs 24, stiffener bars 60 have a base 71 wider than a top surface 72 that facilitate movement of the wearer's toe upward. The shape of stiffener bars 60 and the spacing between each bar add to the flexibility in second direction 40 while providing resistance in first direction 50.

The invention is not limited to the specific processing order of FIG. 3. Rather, the blocks of FIG. 3 may be re-ordered, as necessary, to achieve the results set forth above.

Accordingly, other embodiments are within the scope of the following claims.

What is claimed is:

1. A method for construction of footwear comprising the steps of:

attaching an insole forepart to the bottom of the sock liner;

providing an upper having a vamp lining with a toe part, stitching toe part to the sock liner such that the vamp lining and the sock liner together define a volume for receiving a wearer's foot;

positioning a steel toe substantially around the toe part of the vamp lining;

providing an outsole having a forward portion formed of a material having a first resiliency characteristic;

positioning a stiffener between the forward portion of the outsole and the insole forepart, the stiffener formed of a material having a second resiliency characteristic less than the first resiliency characteristic;

placing a flange of the steel toe between the insole and the stiffener for supporting the steel toe; and opanka stitching at least the forward portion of the outsole to the upper.

2. The method of claim 1 further comprising forming the stiffener to include a plurality of ribs extending across a width of the shoe.

3. The method of claim 2 further comprising forming the stiffener to include a set of indentations along a surface of the stiffener that contacts the outsole.

4. A footwear construction comprising:

a sock liner with an insole forepart attached to the bottom of the sock liner;

an upper having a vamp lining with a toe part, stitching toe part to the sock liner such that the vamp lining and the sock liner together define a volume for receiving a wearer's foot;

a steel toe positioned substantially around the toe part of the vamp lining;

an outsole having a forward portion formed of a material having a first resiliency characteristic, the forward portion opanka-stitched to the upper;

a stiffener between the forward portion of the outsole and the insole forepart, the stiffener formed of a material having a second resiliency characteristic less than the first resiliency characteristic; and said steel toe having a flange, said flange placed between said insole and said stiffener;

wherein said stiffener further provides support to said steel toe.

5. The footwear construction of claim 4 wherein the outsole has a walking surface and an opposed surface opposite to the walking surface, the stiffener embedded in the opposed surface of the outsole.

6. The footwear construction wherein the stiffener has a plurality of ribs formed in a surface of the stiffener that is attached to the outsole.

7. The footwear construction of claim 4 wherein the stiffener has a set of indentations along the surface of the stiffener that is attached to the outsole.

8. A method for providing a shoe, comprising the steps of:

providing an outsole having a forward portion;

placing an insole above the forward portion;

positioning a stiffener between the forward portion and the insole for providing rigidity to the shoe;

placing a flange of a steel toe between the inside and the stiffener;

wherein the stiffener further provides support to the steel toe;

forming the stiffener such that a toe part does not readily bend in a downward direction with respect to a remaining portion of the shoe and to provide flexible support to allow the toe part to bend in an upward direction with respect to the remaining portion of the shoe;

forming a plurality of ribs in a surface of the stiffener that contacts the outsole;

forming the stiffener with a set of indentations along the surface of the stiffener that contacts the outsole.

* * * * *